United States Patent [19]

Tsutsui et al.

[11] 4,297,540

[45] Oct. 27, 1981

[54] INTERLOCKING GANG PUSH-BUTTON SWITCH

[75] Inventors: Kotaroh Tsutsui, Furukawa; Ryoji Kinugawa, Suita, both of Japan

[73] Assignee: Alps Electric Co., Ltd., Tokyo, Japan

[21] Appl. No.: 911,388

[22] Filed: Jun. 1, 1978

[30] Foreign Application Priority Data

Jun. 8, 1977 [JP] Japan ..... 52-74611[U]

[51] Int. Cl.[3] ..... H01H 9/20

[52] U.S. Cl. ..... 200/5 B; 74/483 PB; 200/5 E; 200/50 C

[58] Field of Search ..... 200/5 R, 5 B, 5 C, 5 D, 200/5 E, 5 EA, 5 EB, 50 C, 153 J; 74/483 PB

[56] References Cited

U.S. PATENT DOCUMENTS

| | | | |
|---|---|---|---|
| 3,125,895 | 3/1964 | Ross | 200/5 C X |
| 3,544,739 | 12/1970 | Shah . | |
| 3,719,786 | 3/1973 | Mallett et al. | 200/5 EB |
| 3,722,313 | 3/1973 | Schadow | 200/5 E X |
| 3,836,736 | 9/1974 | Golbeck | 200/5 B |
| 3,889,075 | 6/1975 | Morrell et al. | 200/5 E |
| 3,927,283 | 12/1975 | Kunimine | 200/5 R |
| 4,122,316 | 10/1978 | Iwasaki et al. | 200/5 B |

FOREIGN PATENT DOCUMENTS 633757 12/1949 United Kingdom .

*Primary Examiner*—James R. Scott

*Attorney, Agent, or Firm*—Guy W. Shoup; Gerard F. Dunne

[57] ABSTRACT

Disclosed is an assembly of ganged push-button switches each movable between a first position and a latching position. The assembly is comprised of a first switch block and a second switch block connected thereto. The operation rod of each push-button switch is formed with a symmetrical cam portion engaging a single latch member common to both blocks of switches so that any switch previously locked into its latched position will be unlatched by the latch member upon actuation of any one of the switches.

7 Claims, 15 Drawing Figures

INTERLOCKING GANG PUSH-BUTTON SWITCH

BACKGROUND OF THE INVENTION

1. Field of the Invention

The present invention relates to an interlocking ganged push-button switch which includes an interlocking mechanism therefor and, more particularly, to an improved interlocking ganged push-button switch of a simple construction provided with miniaturized cam means and an interlocking mechanism which is accurately and smoothly operated.

2. Description of the Prior Art

There have been interlocking ganged push-button switches provided with an interlocking mechanism, the construction of one form of such switch will be described in detail below. In such an interlocking ganged push-button switch, however, two cams and two links are combined together to interlock the push-buttons of such switches. Consequently, errors in dimensions of the contacting portions of the cams and links are accumulated and proper strokes of the cams are difficult to obtain. This prevents accurate and smooth operation of the interlocking ganged push-button switch.

SUMMARY OF THE INVENTION

An object of the present invention is to eliminate the above-described drawbacks encountered in the prior art interlocking ganged push-button switch, by simultaneously operating push-button switches in switch blocks.

To this end, according to the present invention, there is provided an interlocking ganged push-button switch comprising a first switch block including a first frame member, a plurality of first push-button switches supported by the first frame member and having a pair of symmetrical cam portions formed on each respective operation rod of the switch. A second switch block is disposed generally parallel to the first switch block and includes a second frame member and a plurality of second push-button switches supported by the second frame member and also having a pair of symmetrical cam portions formed on their operation rods. Means are provided for connecting the first and second frames to each other, and a latch member having a plurality of cam parts symmetrical with respect to the axis of the latch member and movable in response to the movements of the operation rods of the first or second switch are disposed between the first and second switch blocks so that one of these cam parts is engaged with the corresponding cam portion of the operation rod for the first switch with the other thereof engaged with the corresponding cam portion of the operation rod for the second switch, and urged in one direction by a spring means.

The above and other objects, as well as advantageous features of the invention will become apparent from the following description of the preferred embodiments taken in conjunction with the accompanying drawings.

DESCRIPTION OF THE PREFERRED EMBODIMENTS

Before turning to the description of the preferred embodiments, a known interlocking ganged push-button switch will be described in detail with reference to the accompanying drawings.

Figure 1:
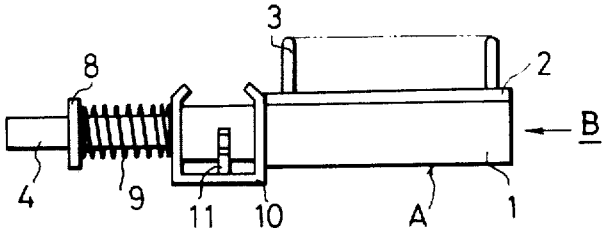
Fig. 1 PRIOR ART
FIG. 1 is a side elevational view of a switch block of a known prior interlocking ganged push-button switch.
Figure 2:
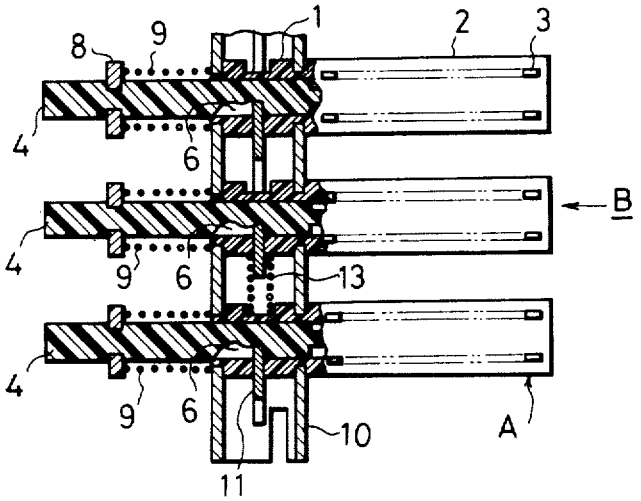
Fig. 2 PRIOR ART
FIG. 2 is a plan view of the switch block as shown in FIG. 1, with a principal portion thereof shown in cross section.
Figure 3:
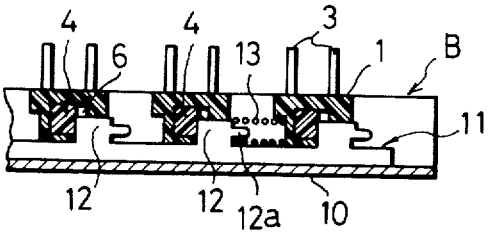
Fig. 3 PRIOR ART
FIG. 3 is a front elevational view of the switch block as shown in FIG. 1, with a principal portion thereof shown in cross section.
Figure 4:
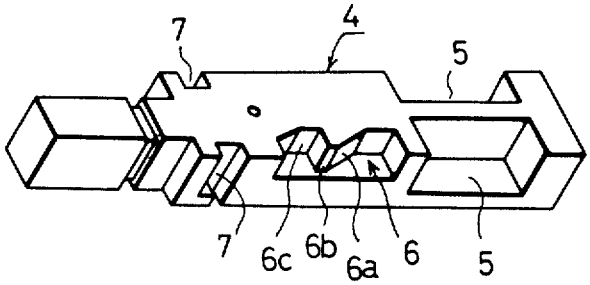
Fig. 4 PRIOR ART
FIG. 4 is a perspective view of an operation rod of the switch shown in FIG. 1.

The switch of FIG. 1 includes a box member 1 made from an electrically insulating material such as a synthetic resin, onto which is fixed an insulating base plate 2 having a plurality of stationary terminals 3 extending vertically therethrough. In the box member 1, an operation rod 4 also made of an electrically insulating material such as a synthetic resin is slidably fitted. The operation rod 4 is shown in FIG. 4 and has recesses 5, into which movable contact members (not shown) are to be fitted, and an interlocking cam portion 6. As shown in FIG. 2, a stopping member 8 is fitted in grooves 7, and a spring 9 is disposed between the stopping member 8 and the front surface of a support 10 to return the operation rod 4 to its original position. A plurality of push-button switches A thus formed are arranged in and secured to the substantially cross-sectionally U-shaped metallic support 10 as shown in FIGS. 1 and 2, so that the cam portions 6 of the operation rods 4 are within the support 10 as shown in FIGS. 2 and 3.

An interlocking latch member 11 having a plurality of cam parts 12 is disposed so that the cam parts 12 are engageable with and disengageable from the interlocking cam portions 6 of the operation rod 4, and a spring 13 is disposed between the base portion of an engagement member 12*a* projected from a cam part 12 and the push-button switch A to return the latch member 11 to its original position. Thus, a switch block B is formed, in which the push-button switches A are interlocked with one another.

Figure 5:
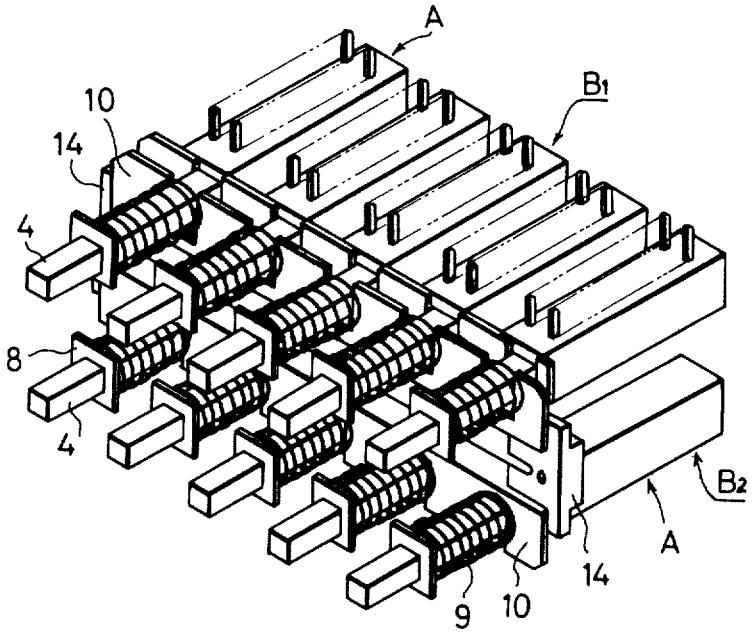
Fig. 5 PRIOR ART
FIG. 5 is a perspective view of a plurality of switch blocks as shown in FIG. 1, which are combined together to form two rows.
Figure 6:
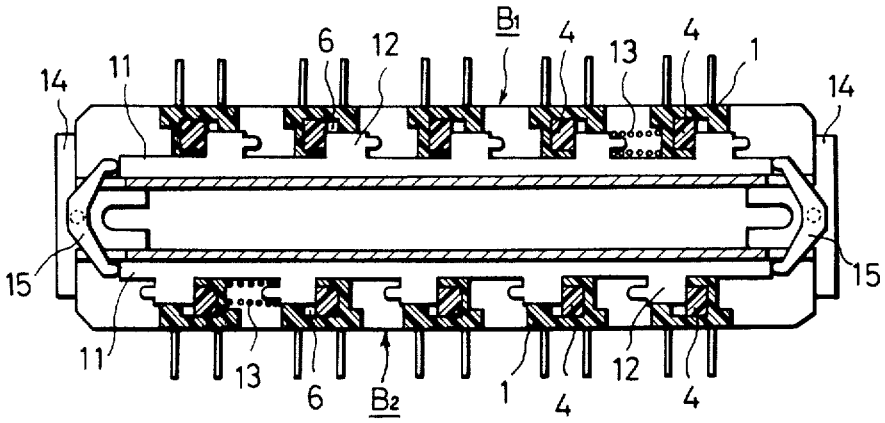
Fig. 6 PRIOR ART
FIG. 6 is a front elevational view of an interlocking mechanism for the switch shown in FIG. 1, with a principal portion thereof shown in cross section.
Figure 7:
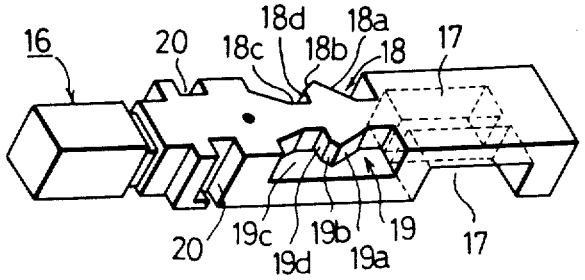
FIG. 7 is a perspective view of an operation rod for an embodiment of the present invention.

The ends of the supports 10 for the two switch blocks $B_1$, $B_2$ are connected to each other with connector members 14 so that these switch block $B_1$, $B_2$ are opposed to each other and integrally fixed as shown in FIG. 5. In order to interlock the push-button switches A in these switch blocks $B_1$, $B_2$, connecting means 15 which are pivotally connected to supporting shafts (not shown) provided in the connector members 14, are disposed at the end portions of the interlocking cam plate 11, as shown in FIG. 6, so that the latch members 11 are interlocked with each other. When desired operation rods 4 in the switch blocks $B_1$, $B_2$ are depressed, the push-button switches in these switch blocks $B_1$, $B_2$ are interlocked with each other. A more detailed description of the above known device can be found in U.S. patent application Ser. No. 758,592 filed Jan. 12, 1977 and resulting in U.S. Pat. No. 4,122,316 on Oct. 24, 1978.

Now, an embodiment of the present invention will be described with reference to FIGS. 7–12, in which the same parts as in the interlocking ganged push-button switch as shown in FIGS. 1–6 are designated by the same reference numerals.

Reference numeral 16 denotes an operation rod slidably fitted in a box member 1 of each push-button switch A'. The operation rod 16 is provided in one surface thereof with recesses 17 into which movable contact members (not shown) are to be fitted. In the opposing surface of the operation rod 16, a pair of symmetrical cam portions 18 and 19 are formed, and these cam portions have respective inclined portions 18*a* or 19*a*, peak portions 18*b* or 19*b*, valley portions 18*c* or 19*c*, and engagement portions 18*d* or 19*d*. Reference numeral 20 denotes grooves into which a stopping member 8 can be fitted.

Figure 8:
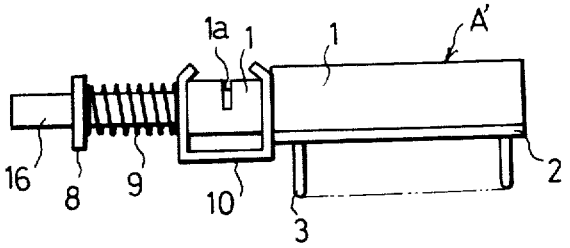
FIG. 8 is a side elevational view of a switch block for an embodiment of the present invention.
Figure 9:
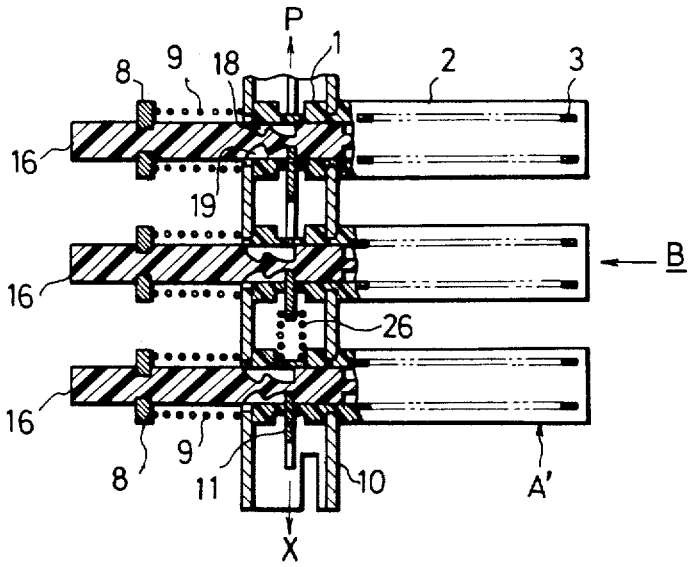
FIG. 9 is a plan view of the switch block as shown in FIG. 8, with a principal portion thereof shown in cross section.
Figure 10:
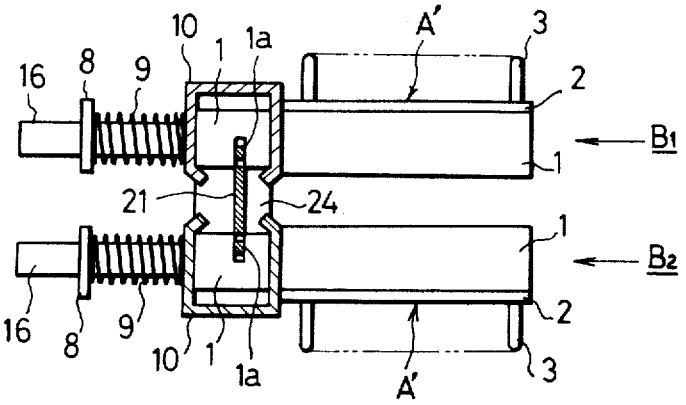
FIG. 10 is a side elevational view of an interlocking ganged push-button switch according to an embodiment of the present invention, with one connecting member removed.

A plurality of push-button switches A' fitted with the operation rods 16 are mounted on a support 10. In the push-button switches A', a row of stationary terminals 3 are secured to and extend outwardly from the lower surface of a box member 1, which lower surface is opposite to the open side of the support 10 as shown in FIGS. 8 and 9. This, of course, is directly opposite to the interlocking ganged push-button switch as shown in FIGS. 1–6, wherein the stationary terminals are secured to the upper surface of support 10. Switch blocks $B_1$, $B_2$ are thus formed. The switch blocks $B_1$, $B_2$ are disposed with the open sides of the respective supports 10 opposed to one another, and connecting members 24 are secured to ends of the supports 10. Thus, the switch blocks $B_1$, $B_2$ are integrally fixed by a suitable means as shown in FIGS. 10, 11.

Figure 11:
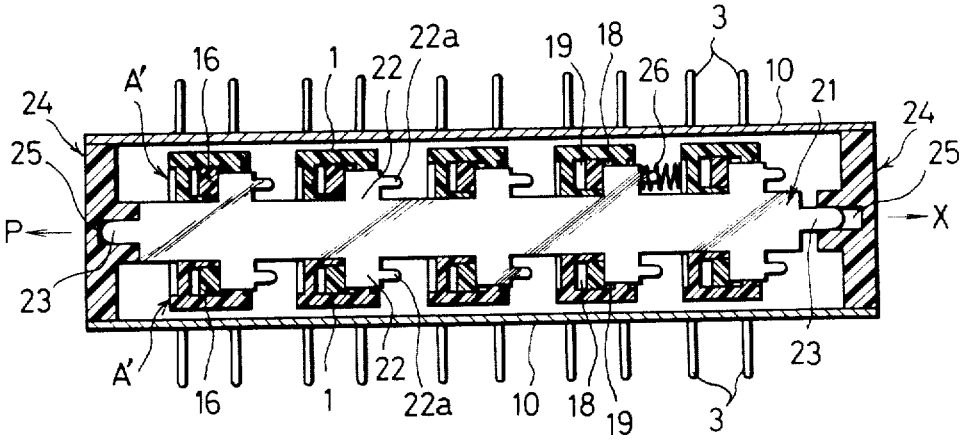
FIG. 11 is a front elevational view of an interlocking mechanism in an embodiment of the present invention, with a principal portion thereof shown in cross section.
Figure 12:
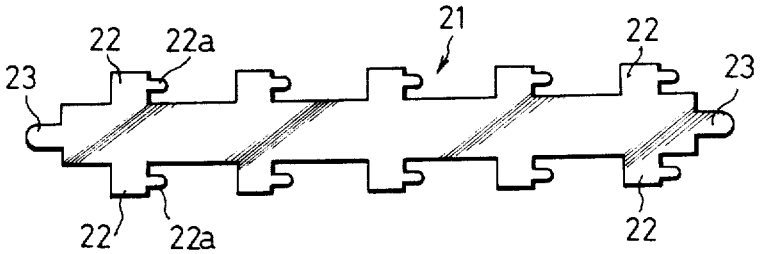
FIG. 12 is a front elevational view of an interlocking cam means for an embodiment of the present invention.

A metallic interlocking latch member 21 has a plurality of symmetrical cam parts 22 along the longitudinal sides thereof and slide portions 23 at each end thereof, as shown in FIG. 12. The slide portions 23 are each slidably fitted in and supported by a respective recesses 25 provided in the connecting members 24. Each cam part 22 enters a groove 1*a* (see FIG. 8) provided in the front portion of the box member 1 of push-button switches A' so that the cam part 22 contacts the cam portion 18 or 19 of the operation rods 16 in switch blocks $B_1$, $B_2$. A spring 26 is provided to thereby return the interlocking latch member 21, as shown in FIG. 11. As shown in FIGS. 11 and 9, one end of the spring 26 is fitted on an engagement member 22*a* projecting from a cam part 22 of the latch member 21, while the base end thereof is secured to the front surface of the box member 1 of an adjacent push-button switch A', so that the spring 26 always urges the latch member 21 in the direction P of FIG. 11. By the urging force of the spring 26, the cam parts 22 at the upper side, in the drawings, of the latch member 21 come into contact with the cam portions 18 of the operation rods 16 in the switch block $B_1$, while the lower cam parts 22 come into contact with the cam portions 19 of the operation rods 16 in the switch block $B_2$. When the switch is not operated, the cam parts 22 at both sides of the latch member 21 are in contact with the inclined portions 18*a* or 19*a* of the cam portions 18 and 19, respectively.

The operation of the switch constructed as described above of an embodiment of the present invention will be described with reference to FIGS. 9 and 11.

When a desired operation rod 16 in the switch block $B_1$ is depressed against the resilient force of the spring 9, the inclined portion 18*a* of that operation rod operates against the associated cam part 22 to move the latch member 21 in the direction X as shown in FIGS. 9 and 11, and compresses the spring 26. When, during this movement of the interlocking cam plate 21, the cam parts 22 have passed the peak portions 18*b* of the cam portions 18 of the operation rod, the cam parts 22 are urged into the valley portions 18*c* by the resilient force of the spring 26. At the same time, the interlocking latch member 21 moves in the direction P, as shown in FIGS. 9 and 11, and returns to its original position, while the movement of the operation rod 16 is stopped with the rear end thereof contacting the back of the box member 1. When the operation rod 16 is then released, the engagement portions 18*d* engage with the associate cam part 22 so that the operation rod 16 is not returned to its original position but locked as it is. (At this time, the switch is changed over.) When a desired operation rod 16 in the switch block $B_2$ is then depressed, the inclined portion 19*a* of this rod urges the associated cam part 22 so as to move the interlocking latch member 21 in the direction of the arrow X. Thus, the interlocking latch member 21 will come to be locked in the same manner as mentioned above. When the interlocking latch member 21 is thus moved, any operation rod 16 which has been previously locked is released as the engagement portions 18*d* thereof are disengaged from the associate cam part 22 by a movement of the latch member 21. When another operation rod 16 in the switch blocks $B_1$ or $B_2$ is then depressed, it is locked in the same manner as mentioned above and, at the same time, any operation rod 16 which has been locked is released. In the switch of this embodiment, each of the operation rods 16 in the switch blocks $B_1$ and $B_2$ is interlocked with every other operation rod by a single interlocking latch member 21.

In the interlocking ganged push-button switch of the present invention, each of the operation rods 16 in the switch blocks $B_1$ and $B_2$ is interlocked by a single interlocking latch member 21 owing to the pair of symmetrical cam portions 18 and 19 of the operation rods 16. Thus, unlike the prior art interlocking ganged push-button switch, connecting members such as those shown as elements 15 in FIG. 6 are not needed in the switch of the present invention. Consequently, the interlocking push-button switch of the present invention has a more simple construction and can be miniaturized and assembled easily. The strokes of the interlocking cam plate 21 in the switch of the present invention can be easily determined and this allows the switch to be accurately and smoothly operated as well as the productivity and performance thereof to be improved.

Figure 13:
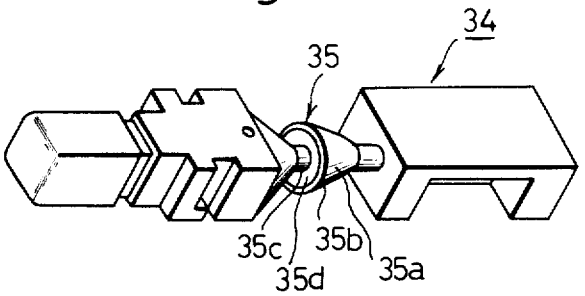
FIG. 13 is a perspective view of another embodiment of the operation rod.

FIG. 13 shows another embodiment of an operation rod which has a conical cam 35 instead of the two cam portions of the embodiment as described above. Referring to the FIG. 13, reference numeral 35*a* denotes an inclined portion, 35*b* a peak portion, 35*c* a valley portion, and 35*d* an engagement portion. This cam has the same operation as the cam portions 18 and 19 of the operation rod 16 in the embodiment described previously.

Figure 14:
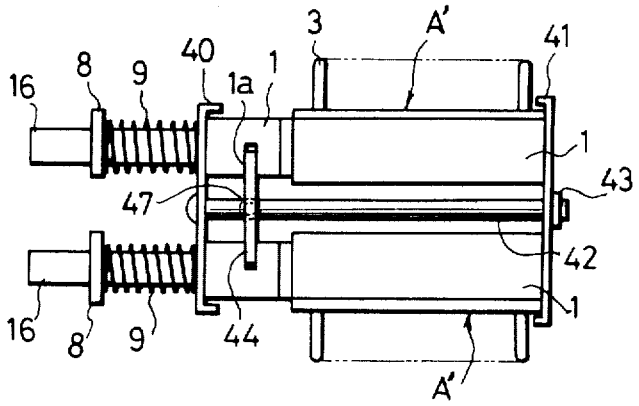
FIG. 14 is a side elevational view of an interlocking ganged push-button switch of another embodiment of the present invention.
Figure 15:
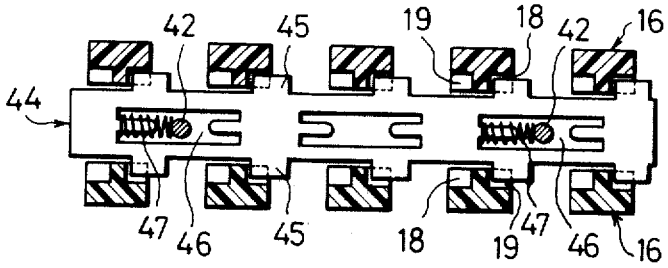
FIG. 15 is a front elevational view of an interlocking mechanism for the embodiment shown in FIG. 14, with a principal portion thereof shown in cross section.

FIGS. 14 and 15 show another embodiment of the interlocking push-button switch provided with an interlocking mechanism of the present invention. In FIGS. 14 and 15, the parts designated by the same reference numerals as those used in FIGS. 10 and 11 are the same ones as those shown in FIGS. 10 and 11. A plurality of push-button switches A' are arranged in two rows to oppose one another. A front plate 40 and a rear plate 41 are attached to the front and rear surfaces, respectively, of two adjacent switches, and a screw rod 42 is passed through holes (not shown) in these plates 40 and 41. The screw rod 42 can then be tightened by means of a nut 43 fitted on a portion thereof that projects beyond the rear plate 41. Thus, the push-button switches A' are integrally fixed so that a plurality of cam parts 45 formed along the longitudinal sides of an interlocking latch member 44 are engageable with and disengageable from cam portions (not shown) of operation rods 16 in the push-button switches A' in each row in the same manner as in the previously-described embodiment of the present invention. In addition, springs 47 for returning the interlocking cam plate 44 to its initial position are provided in respective rectangular openings 46 in the latch member, and are supported by a respective edge portion of the openings 46 and respective screw rods 42. This push-button switch has an operation similiar to that of the previously-described embodiment.

What is claimed is:

1. In a switch assembly comprising a first and a second block of identical push button switches, each said switch including a plurality of fixed terminals arranged along its length and having an operation rod movable inwardly to a latched position electrically contacting a selected one of said terminals, said blocks being arranged generally parallel in back to back relation with their fixed terminals extending oppositely, and means for releasing any switch from its latched position when any other switch is actuated to its latched position, the improvement comprising said releasing means including identical first and second cam portions formed on respective sides of the operation rods of said switches, and a common latch member having first cam parts on one side thereof for engaging said first cam portions and second cam parts on the opposing side thereof engaging said second cam portions.

2. A switch assembly according to claim 1, said latch member including a plurality of engagement portions extending along the longitudinal edges of said latch member and each adapted to engage a cam portion of a respective operation rod, said releasing means further including a coil spring biasing said latch member in its initial position, said coil spring having one end fitted over one of said engagement portions and the other end held stationary.

3. A switch assembly according to claim 1, said switch blocks being connected together by connecting members holding adjacent end portions of said blocks, said latch member having a slide portion located in at least one end thereof and slidable with a guide provided in a respective one of said connecting members.

4. A switch assembly according to claim 1, each said cam portion consisting of an inclined portion for sliding said latch member out of engagement with the cam portion of any latched operation rod, a peak portion and an engagement portion adapted to abut against said latch member to hold the operation rod in its latched position.

5. A switch assembly according to claim 4, said identical cam portions on each operation rod being formed by a generally conically shaped member.

6. A switch assembly according to claim 1, adjacent switches from each of said blocks having a common front plate and a common rear plate held together by a common rigid member held to each plate.

7. A switch assembly according to claim 6, said releasing means further including a coil spring biasing said latch member in its initial position and held within a central opening therein.

* * * * *